United States Patent [19]

Ebata

[11] Patent Number: 4,623,139

[45] Date of Patent: Nov. 18, 1986

[54] PAPER TRANSPORTING MECHANISM OF A PRINTER

[75] Inventor: Yoshikazu Ebata, Tokyo, Japan

[73] Assignee: Janome Sewing Machine Industry Co., Ltd., Japan

[21] Appl. No.: 795,951

[22] Filed: Nov. 7, 1985

[30] Foreign Application Priority Data

Nov. 9, 1984 [JP] Japan ..... 59-169165[U]

[51] Int. Cl.[4] ..... B65H 5/06

[52] U.S. Cl. ..... 271/272; 400/641; 400/642; 400/645.1

[58] Field of Search ..... 271/272, 273, 274, 314, 271/3; 400/625, 636, 637, 637.2, 641, 630, 642, 645.1, 638, 637.3, 639

[56] References Cited

U.S. PATENT DOCUMENTS 4,243,330 1/1981 Wallace ..... 400/642

4,475,833 10/1984 Sawicki ..... 400/642 X

*Primary Examiner*—Richard A. Schacher

*Attorney, Agent, or Firm*—William A. Drucker

[57] ABSTRACT

A paper transporting mechanism is disclosed in connection with a printer having a printing head mounted on a carriage reciprocatingly moved transversely of a printing paper to be printed by the printing head and a platen arranged opposite to the printing head with a clearance being provided therebetween for passing the printing paper therethrough, wherein a first pair of rollers is frictionally rotated to transport the printing paper in the direction toward the printing head and platen, a second pair of rollers is frictionally rotated to transport the printing paper in the direction away from the printing head and platen, a guide is provided between the first and second pairs of rollers, the guide including a first guide plate for guiding the printing paper in the direction toward the printing head and platen and a second guide plate for guiding the printing paper in the direction away from the printing head and platen, the first and second guide plates being integrated to each other to provide opposite insertions, and a support includes a predetermined number of bearings mounted on a pair of side frames of the printer to support the first and second pairs of rollers between side frames, each of the bearings are so structured as to receive the insertions of the guide to support the latter between the frames while the bearings are prevented from rotation with respect to the side frames by the insertions.

3 Claims, 6 Drawing Figures

PAPER TRANSPORTING MECHANISM OF A PRINTER

BACKGROUND OF THE INVENTION

The invention relates to a printer, and more particularly relates to a mechanism of a printer for transporting a printing paper to be printed in a direction toward a printing head and a platen and in a direction away from the printing head and the platen wherein the mechanism may be easily assembled with a required precision without any special adjustments of the related elements.

With a recent wide spread of personal computers and word processors, so called the office appliances generally used in many offices, printers have come to be used in combination with such appliances. The printers are provided with a printing head including characters, wires, etc., to effect printing on a printing paper in cooperation with a platen arranged opposite to the printing head with a clearance therebetween for passing the printing paper therethrough. In these printers the printing paper is transported in the direction transversely of the platen by means of a pair of frictional rollers provided on one side of the platen transversely thereof and another pair of frictional rollers provided on the other side of the platen transversely thereof while the printing paper is guided by a paper guide mechanism provided between the two pairs of frictional rollers. Generally the paper transporting mechanism includes rotational rollers rotatably mounted between the frames of printer for transporting the printing paper and guide plates arranged between the rotational rollers for guiding the printing paper. It has therefore been required to assemble these separate and individual transporting rollers and guide plates while they are precisely adjusted to each other to correctly determine the paper transporting path with respect to the printing head and the platen in a manner as to keep the printing paper clean from the ink platen or ink ribbon, and free from being materially damaged, and also to avoid causing noises during the printing operation. Especially in a polychrome printer having a platen having a number of porous elements arranged therearound each impregnated with an ink of different color, it is required to reduce to the smallest possible the clearance between the platen and the printing paper in order to avoid causing undesired noises during the printing operation. In this case, the failure of required adjustments will often spoil the printing paper with the ink of platen as the latter is transported.

SUMMARY OF THE INVENTION

The invention has been provided to eliminate the defects and advantages of the prior art. It is therefore a primary object of the invention to provide a paper transporting mechanism of a printer which is simple in structure and may be easily assembled with a required precision without the need of special adjustments of relates elements. It is another object of the invention to produce the mechanism very easily and at lower cost. In order to attain the objects as mentioned above, the invention provides a first guide plate for guiding the printing paper in the direction toward the printing head and the platen and a second guide plate for guiding the printing paper in the direction away from the printing head and the platen, the first and second guide plates being formed as integrated to each other, and also provides support means for supporting in common the integrated guide plates and the rotational transporting rollers.

In short, the present invention relates to a paper transporting mechanism of a printer having a printing head mounted on a carriage reciprocatingly moved along a guide shaft extended between two oppositely arranged side frames transversely of a printing paper to be printed by the printing head and a platen arranged opposite to the printing head with a clearance being provided therebetween for passing the printing paper therethrough, said paper transporting mechanism comprising:

(a) first frictional means including a first rotational roller having a roller shaft providing opposite ends, and a second roller arranged in contact with said first rotational roller and frictionally rotated in association with the latter to transport said printing paper in the direction toward said printing head and said platen;

(b) second frictional means including a second rotational roller having a roller shaft providing opposite ends, and a third roller arranged in contact with said second rotational roller and frictionally rotated in association with the latter to transport said printing paper in the direction away from said printing head and said platen;

(c) guide means provided between said first and second frictional means, said guide means including a first guide plate arranged to guide said printing paper in the direction toward said printing head and said platen and a second guide plate arranged to guide said printing paper in the direction away from said printing head and said platen, said first and second plates having opposite ends integrated to each other to provide opposite insertions; and (d) support means including a predetermined number of bearings mounted in pairs on said oppositely arranged side frames, each of said bearings having a hole for receiving therein each of the ends of said roller shafts and groove for receiving therein each of said insertions of said guide means, to thereby support said rotational rollers and said guide means on said side frames, said insertions preventing said bearings from being rotated with respect to said side frames.

Other features and advantages of the invention will be apparent from the following description of a preferred embodiment in reference to the attached drawings.

DETAILED DESCRIPTION OF THE INVENTION

Figure 1:
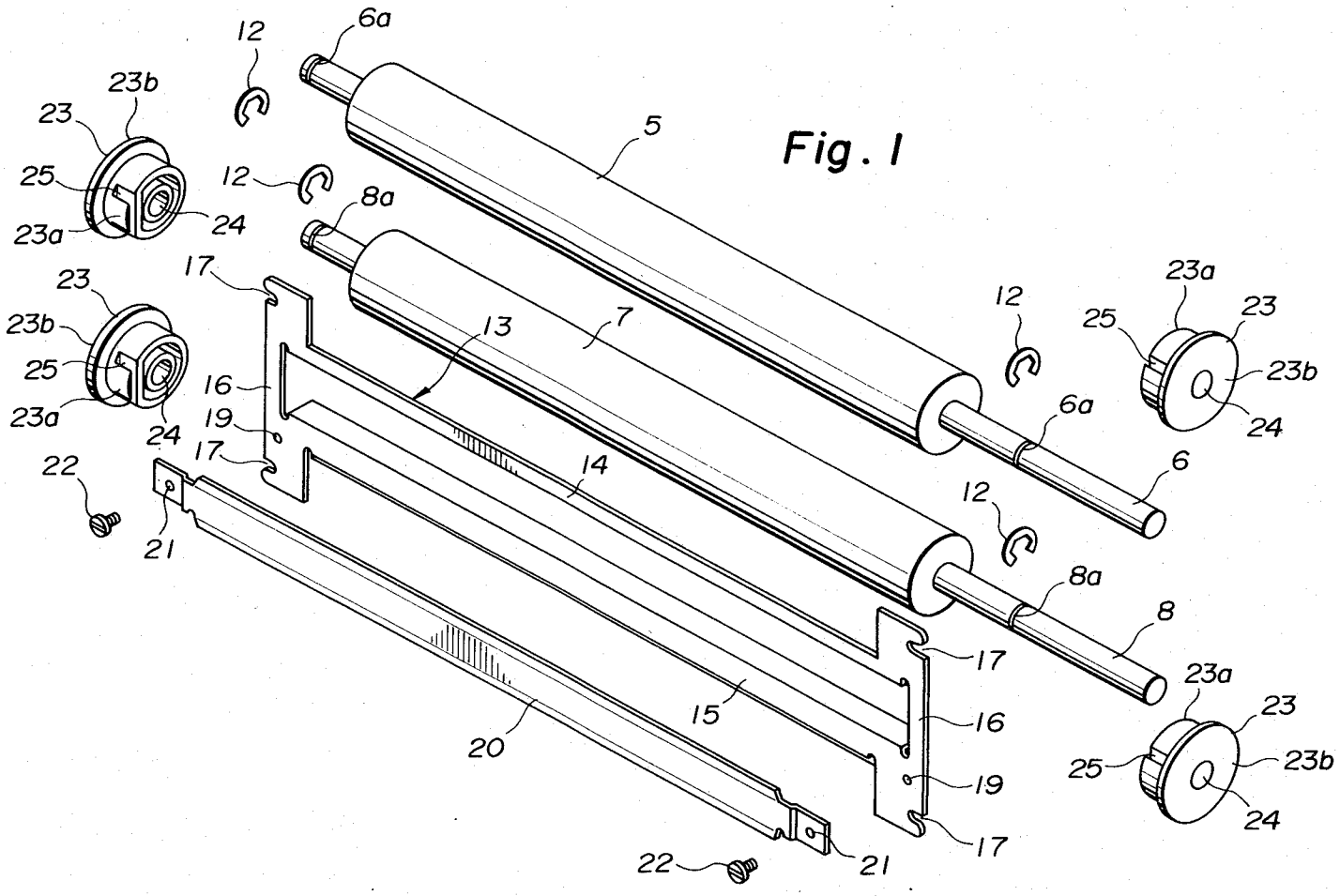
FIG. 1 is an exploded perspective view of the invention.
Figure 2C:
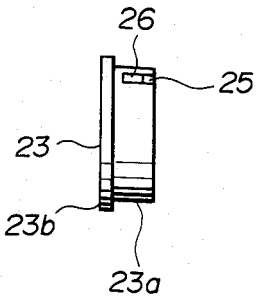
FIG. 2C is a side elevational view of FIG. 2A.
Figure 2A:
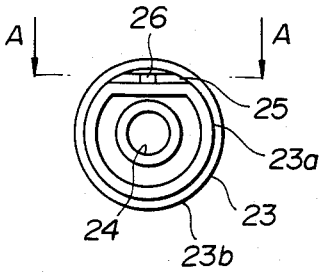
FIG. 2A is a front elevational view of a bearing of the invention.
Figure 2B:
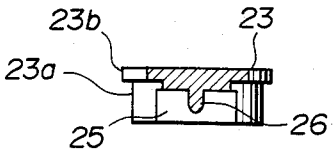
FIG. 2B is a plan view taken along a line A—A of FIG. 2(A)
Figure 4:
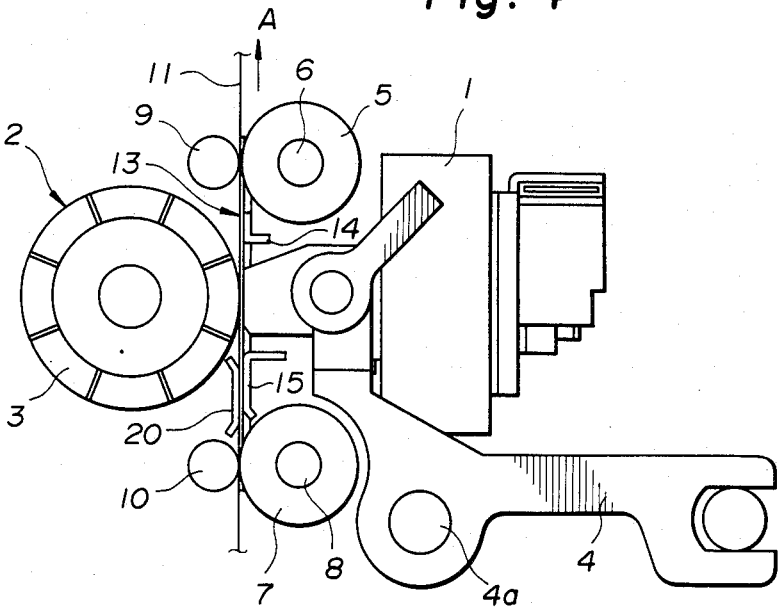
FIG. 4 is a side elevational view of the invention.
Figure 3:
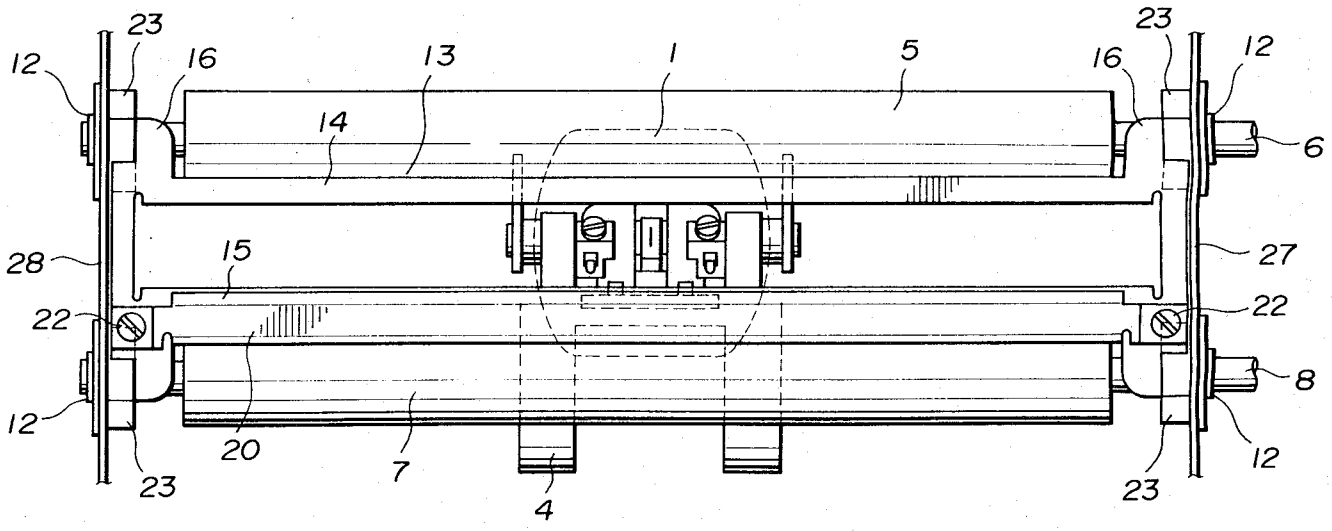
FIG. 3 is a front elevational view of the invention.

As particularly shown in FIG. 4, a printing head 1 is mounted on a carriage 4 which is reciprocatingly moved along a guide shaft 4*a* extending transversely of a printing paper 11 to be printed by the printing head 1. A platen 2 is arranged opposite to the printing head 1 with a clearance being provided therebetween to pass the printing paper 11 therethrough. The platen 2 has a plurality of porous elements 3 arranged therearound each impregnated with an ink of different color for polychrome printing.

Further in reference to FIGS. 1 through 4, the printing paper 11 is transported with respect to the printing head 1 and the platen 2 in the direction as indicated by an arrow mark A by a frictional transporting mechanism including an upper rotational roller 5 having a roller shaft 6 and a roller 9 which is in contact with the rotational roller 5 and is frictionally rotated in association with the latter to transport the printing paper 11 in the direction away from the printing head 1 and the platen 2, and a lower rotational roller 7 having a roller shaft 8 and a roller 10 which is in contact with the rotational roller 7 and is frictionally rotated in association with the latter to transport the printing paper toward the printing head 1 and the platen 2. The paper transporting mechanism further includes a paper guide 13 arranged between the upper and lower rotational rollers 5, 7. The guide 13 is composed of an upper guide plate 14 laterally extended immediately below the upper rotational roller 5 for guiding the printing paper 11 in the direction away from the printing head 1 and the platen 2, and a lower guide plate 15 laterally extended immediately above the lower rotational roller 7 for guiding the printing paper 11 in the direction toward the printing head 1 and the platen 2. Further an auxiliary guide plate 20 is laterally extended opposite to the lower guide plate 15 for cooperating with the latter to guide the printing paper 11. The upper and lower guide plates 14, 15 are connected to each other at both ends thereof by integrated vertical plates 16, each of which has a pair of notches 17 formed at the upper and lower end parts thereof and a threaded hole 19 formed at the lower part thereof. The auxiliary guide plate 20 is formed with a pair of holes 21 at the ends thereof, and is secured to the guide 13 against the lower guide plate 15 with a paper guiding clearance provided therebetween by means of a pair of fastening screws 22 each extended into each of the holes 21 and then threaded into each of the threaded holes 19.

Two pairs of bearings 23 are provided. These bearings are mounted in pairs on both side frames 27, 28 of the printer in a manner as to receive therein the ends of roller shafts 6, 8 of the rotational rollers 5, 7. As particularly shown in FIG. 2, each of the bearings 23 is composed of a cylinder portion **23*a* and a flange portion 23*b*. The cylinder portion 23*a* is provided with an axial center hole 24 for receiving therein the end of the roller shaft and is further provided with a groove 25 having a projection 26** formed as extended thereacross.

The elements as mentioned above are assembled as follows:

At first, both ends of the roller shafts 6, 8 of the rotational rollers 5, 7 are inserted into holes (not shown) of the side frames 27, 28. Then the bearings 23 are inserted onto the respective ends of the roller shafts 6, 8 by means of the axial center holes 24 thereof and the cylinder portions **23*a* of the bearings 23 are inserted into the respective holes of the side frames 27, 28 until the flange portions 23*b* come in contact with the outer faces of the side frames. Subsequently the integrated vertical plates 16 on both sides of the guide 13 are inserted into the respective grooves 25 of the bearings 23 in a manner that the respective notches 17 of the integrated vertical plates 16 engage the respective projections in the grooves 25 of the bearings 23. Finally each of stop rings 12 is fitted into each of grooves 6*a*, 8*a* of the roller shafts 6, 8 on the outside of each flange portion 23*b* of the bearings 23 to prevent each of the bearings 23 from moving axially of the roller shafts 6, 8, while the bearings 23 are prevented from rotation due to the engagement thereof with the integrated vertical plates 16 of guide 13** as mentioned above.

Thus the guide 13 includes the upper guide plate 14 and the lower guide plate 15, both of which are integrated, and an auxiliary guide plate 20 secured to the guide 13 against the lower guide plate 15. The upper guide plate 14 and the lower guide plates 15, 20 are so designed to be positioned in predetermined positions with respect to the upper rollers 5, 9 and the lower rollers 7, 10 for transporting the printing paper 11. Without the need of positional adjustments at the time of assembling of the elements. Further the mechanism of the invention may be easily assembled with a predetermined precision.

What is claimed is:

1. A paper transporting mechanism of a printer having a printing head mounted on a carriage reciprocatingly moved along a guide shaft extended between two oppositely arranged side frames transversely of a printing paper to be printed by the printing head and a platen arranged opposite to the printing head with a clearance being provided therebetween for passing the printing paper therethrough, said paper transporting mechanism comprising:

(a) first frictional means including a first rotational roller having a roller shaft providing opposite ends, and a second roller arranged in contact with said first rotational roller and frictionally rotated in association with the latter to transport said printing paper in the direction toward said printing head and said platen;

(b) second frictional means including a second rotational roller having a roller shaft providing opposite ends, and a third roller arranged in contact with said second rotational roller and frictionally rotated in association with the latter to transport said printing paper in the direction away from said printing head and said platen;

(c) guide means provided between said first and second frictional means, said guide means including a first guide plate arranged to guide said printing paper in the direction toward said printing head and said platen and a second guide plate arranged to guide said printing paper in the direction away from said printing head and said platen, said first and second plates having opposite ends integrated to each other to provide opposite insertions; and (d) support means including a predetermined number of bearings mounted in pairs on said oppositely arranged side frames, each of said bearings having a hole for receiving therein each of the ends of said roller shafts and a groove for receiving therein each of said insertions of said guide means, to thereby support said rotational rollers and said guide means on said side frames, said insertions preventing said bearings from being rotated with respect to said side frames.

2. A mechanism as defined in claim 1, further comprising an additional guide plate secured to said guide means against said first guide plate with a clearance being provided therebetween for passing said printing paper therethrough.

3. A mechanism as defined in claim 1, wherein each of said bearings has a projection extended transversely of said groove thereof, and each of said insertions having a pair of notches each to engage said projection in said groove to thereby support said guide on said frames and to prevent each of said bearings from being rotated with respect to said side frames.

* * * * *